US005106292A

United States Patent [19]

Ejiri et al.

[11] Patent Number: 5,106,292

[45] Date of Patent: Apr. 21, 1992

[54] PULSE COMBUSTION DEVICE

[75] Inventors: Susumu Ejiri; Tsuneyasu Hayakawa, both of Aichi, Japan

[73] Assignee: Paloma Kogyo Kabushiki Kaisha, Nagoya, Japan

[21] Appl. No.: 727,531

[22] Filed: Jul. 9, 1991

[30] Foreign Application Priority Data

Jul. 10, 1990 [JP] Japan ..... 2-73709[U]

[51] Int. Cl.[5] ..... F23C 11/04

[52] U.S. Cl. ..... 431/1

[58] Field of Search ..... 431/1

[56] References Cited

U.S. PATENT DOCUMENTS 4,457,691 7/1984 Hisaoka et al. ..... 431/1

4,881,373 11/1989 Yamaguchi et al. ..... 431/1

*Primary Examiner*—Carroll B. Dority

*Attorney, Agent, or Firm*—Fleit, Jacobson, Cohn, Price, Holman & Stern

[57] ABSTRACT

In a pulse combustion device including a housing forming therein a combustion chamber, a cylindrical support member joined to the housing to form a mixing chamber in open communication with the combustion chamber, an annular perforated flange member coupled with an opene end of the support member and having a cylindrical portion provided at its center to form a gas passage in communication with the mixing chamber, an air inlet valve assembly mounted within the flange member to allow inward flow of air passing therethrough into the mixing chamber, and a gas inlet valve assembly disposed within the cylindrical portion to allow inward flow of gaseous fuel passing therethrough into the mixing chamber, an annular heat-blocking plate is arranged to oppose an aperature between the mixing chamber and the combustion chamber and mounted on the cylindrical portion of the flange member between the air inlet valve assembly and the aperture to block radiant heat of combustion products applied thereto from the combustion chamber for protecting the air inlet valve assembly.

5 Claims, 2 Drawing Sheets

PULSE COMBUSTION DEVICE

BACKGROUND OF THE INVENTION

1. Field of the Invention

The present invention relates to pulse combustion devices using flapper-type air and gas inlet valves, and more particularly to an air inlet valve assembly in the pulse combustion device.

2. Description of the Prior Art

In U.S. Pat. No. 4,715,807 issued on Dec. 29, 1987 there has been proposed a pulse combustion device which includes a housing forming therein a combustion chamber, a cylindrical support member joined to the housing to form a mixing chamber in open communication with the combustion chamber, an annular perforated flange member coupled with an open end of the support member, a cylindrical member mounted in the center of the flange member to form a gas passage in open communication with the mixing chamber, an annular valve plate formed with a plurality of circumferentially equally spaced air ports and being secured to annular end surfaces of the flange member and the cylindrical member, a flapper-type gas inlet valve unit disposed within the cylindrical member, and a plurality of circumferentially equally spaced air inlet valve units mounted on the valve plate in surrounding relationship with the gas passage.

In such a pulse combustion device as described above, a cup-shaped distribution head is secured to an inner end of the cylindrical member to protect the gas inlet valve unit from radiant heat of the combustion products applied from the combustion chamber. However, the air inlet valve units are directly exposed to the radiant heat of the combustion products. As a result, durability of the air inlet valve units is deteriorated in a short period of time. Such a problem will arise particularly in a pulse combustion device in which the air inlet valve units are arranged adjacent the central portion of the mixing chamber to increase combustion capacity of the device.

SUMMARY OF THE INVENTION

It is, therefore, a primary object of the present invention is to provide an improved pulse combustion device wherein the air inlet valve units can be protected from the radiant heat of the combustion products in a simple construction.

According to the present invention, the object is attained by providing a pulse combustion device which includes a housing forming therein a combustion chamber, a cylindrical support member joined to the housing to form a mixing chamber in open communication with the combustion chamber, an annular perforated flange member coupled with an open end of the support member and having a cylindrical portion provided at its center to form a gas passage in communication with the mixing chamber, an air inlet valve assembly mounted within the flange member to allow inward flow of air passing therethrough into the mixing chamber and to block outward flow of the air from the mixing chamber, and a gas inlet valve assembly disposed within the cylindrical portion to allow inward flow of gaseous fuel passing therethrough into the mixing chamber and to block outward flow of the gaseous fuel from the mixing chamber, wherein an annular heat-blocking plate is arranged within the mixing chamber to oppose an aperture between the mixing chamber and the combustion chamber and mounted on the cylindrical portion of the flange member between the air inlet valve assembly and the aperture to block radiant heat of combustion products applied thereto from the combustion chamber through the aperture for protecting the air inlet valve assembly.

BRIEF DESCRIPTION OF THE DRAWINGS

Other objects, features and advantages of the present invention will become more readily apparent from the following detailed description of a preferred embodiment thereof when taken together with the accompanying drawings, in which.

DESCRIPTION OF THE PREFERRED EMBODIMENT

Figure 1:
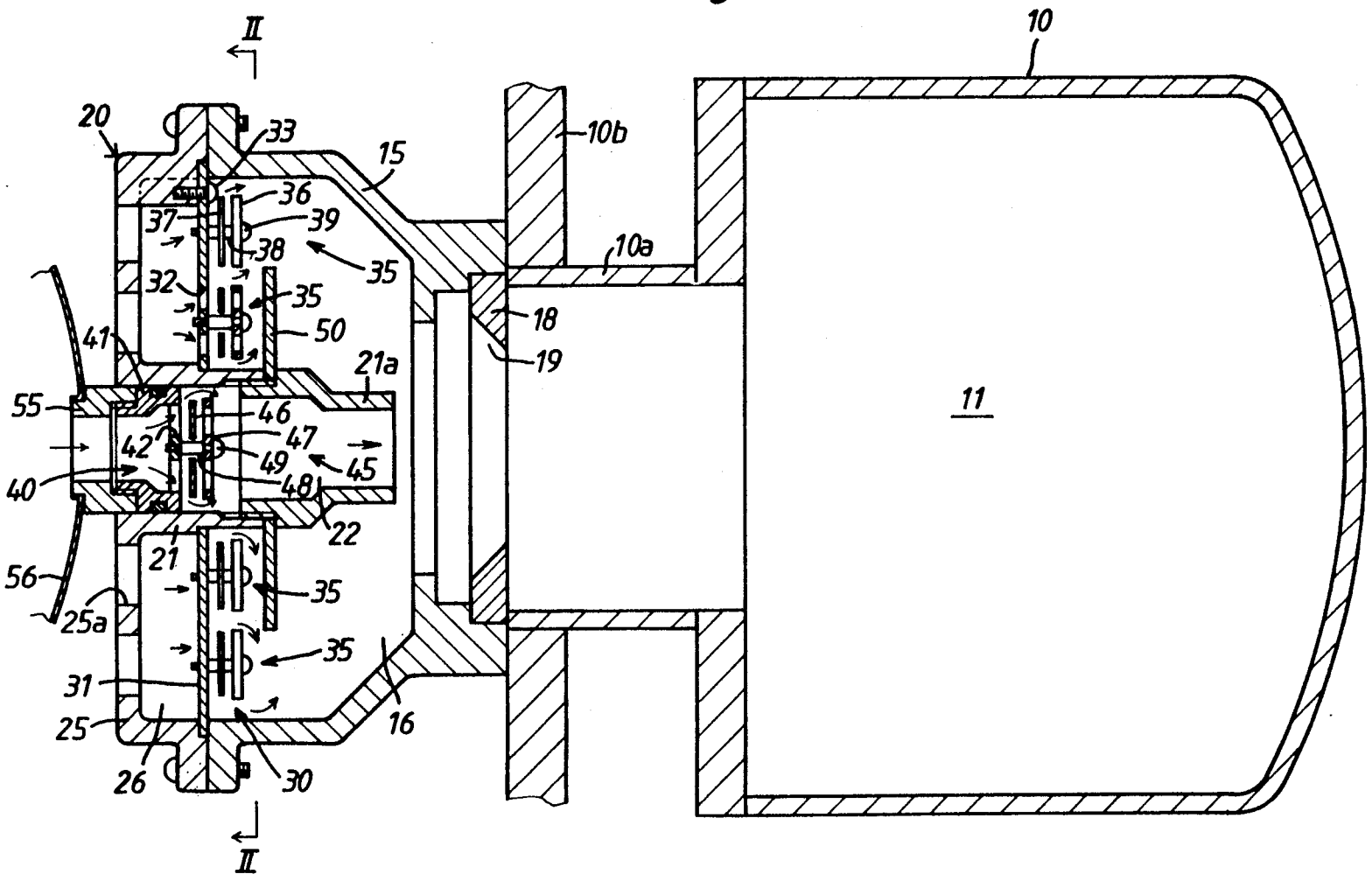
FIG. 1 is a sectional view of a pulse combustion device in accordance with the present invention.

In FIG. 1 of the drawings, there is illustrated a pulse combustion device which includes a housing 10 forming therein a combustion chamber 11, a cylindrical support member 15 forming therein a mixing chamber 16, and a valve housing assembly 20 coupled with an open end of support member 15. The housing 10 has an end wall formed with an aperture for communication with the mixing chamber 16. A connecting pipe 10*a* is welded at its one end to the end wall of housing 10 and at its other end to a mounting flange 10*b* for connection to a side wall of a cooking vessel (not shown). The housing 10 has another end wall forming the combustion chamber 11 and supporting a tailpipe (not shown) connected thereto in a fluid-tight manner. The housing 10 and tailpipe are fully immersed in an amount of liquid such as cooking oil or water stored in the vessel. The tailpipe is arranged to receive combustion products from the combustion chamber 11 and extends outwardly from the vessel to deliver the combustion products to an exhaust. The cylindrical support member 15 has a bottom wall formed with an aperture for communication between the mixing chamber 16 and the combustion chamber 11 and is secured to the mounting flange 10*b* through an annular guide member 18 coaxially with the connecting pipe 10*a*.

The valve housing assembly 20 includes an annular flange member 25 secured to the open end of support member 15 in a fluid-tight manner by means of bolts. The annular flange member 25 is integrally formed at its center with a cylindrical portion 21 which forms therein a gas passage 22 in open communication with the mixing chamber 16. A tapered head pipe 21*a* is threaded into an inner end of the cylindrical portion 21 of flange member 25. The flange member 25 forms therein an annular air flow passage 26 in surrounding relationship with the cylindrical portion 21 and is formed with a plurality of circumferentially equally spaced openings 25*a*.

Figure 2:
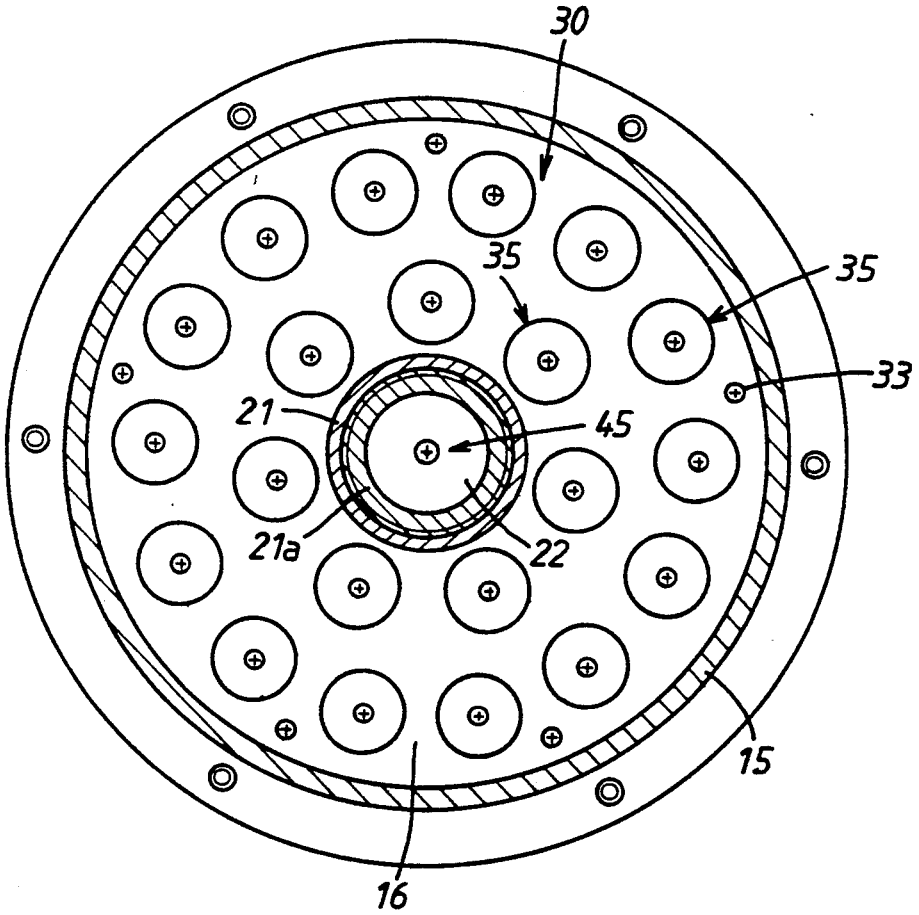
FIG. 2 is a cross-sectional view taken along line II—II in FIG. 1, illustrating an arrangement of flapper-type air inlet valve units adapted to the pulse combustion device.

A flapper-type air inlet valve assembly 30 is mounted on the flange member 25 to permit inward flow of air passing therethrough from the air flow passage 26 into the mixing chamber 16 and to block outward flow of fuel-air mixture from the mixing chamber 16. As shown in FIGS. 1 and 2, the air inlet valve assembly 30 includes an annular valve plate 31 secured to annular end surfaces of the support member 15 and flange member 25 by means of screws 33, and a plurality of circumferentially equally spaced valve units 35 mounted on the valve plate 31. As shown in FIG. 2, the valve units 35 are arranged on the valve plate 31 on inside and outside common circular paths concentric with the cylindrical portion 21 of flange member 25. The valve plate 31 is formed with a plurality of circumferentially equally spaced circular air ports 32 which are each formed by a plurality of circumferentially equally spaced radial slots and located on the inside and outside common circular paths.

The valve units 35 each includes a circular backer plate 36 arranged within the mixing chamber 16 to oppose each of the air ports 32 and fixed to the valve plate 31 through a spacer 38 by means of a screw 39, and a circular air flapper 37 movable between the valve plate 31 and the backer plate 36. The circular backer plate 36 is slightly larger in diameter than the circular air port 32 and is formed with a plurality of circumferentially equally spaced small holes. The air flapper 37 is in the form of a circular flexible thin plate made of a heat-resisting fabric coated with heat-resisting synthetic resin and formed at its center with a hole through which the spacer 38 is inserted. With negative pressure in the mixing chamber 16, the air flappers 37 are lifted off the air ports 32, allowing air to flow into the mixing chamber 16 from the air flow passage 26 therethrough. During intermittent periods of positive pressure in the mixing chamber 16, the air flappers 37 are seated over the air ports 32, closing them off. The air flappers 37 each are slightly larger in diameter than the air port 32 and slightly smaller in diameter than the backer plate 36.

Disposed within the cylindrical portion 21 of flange member 25 is an outlet sleeve 55 which is secured to a gas container 56 forming therein a gas cushion chamber. The gas container 56 is connected in a usual manner to a source of gaseous fuel (not shown). The outlet sleeve 55 is screwed into the gas passage 22 of cylindrical portion 21 in a fluid-tight manner. Within the gas passage 22 of cylindrical portion 21, a flapper-type gas inlet valve assembly is coupled with the outlet sleeve 55 to allow inward flow of gaseous fuel passing therethrough from the gas container 56 into the mixing chamber 16 and to block outward flow of fuel-air mixture from the mixing chamber 16. The gas inlet valve assembly includes a cup-shaped valve seat member 41 screwed into the outlet sleeve 55, and a gas inlet valve unit 45 the construction of which is substantially the same as the air inlet valve unit 35. The gas inlet valve unit 45 is composed of a circular backer plate 47 fixed to the central portion of valve seat member 41 through a spacer 48 by means of a screw 49, and a circular gas flapper 46 movable between the valve seat member 41 and the backer plate 47. When the air flappers 37 of valve units 35 are lifted off the air ports 32, the gas flapper 46 of valve unit 45 is lifted off gas ports 42 of valve seat member 41 to introduce gaseous fuel into the mixing chamber 16 from the gas container 56 through the gas passage 22. When the air flappers 37 are seated over the air ports 32, the gas flapper 46 is seated over the gas ports 42 to block a reverse flow of gaseous fuel from the mixing chamber 16.

In the pulse combustion device described above, an annular heat-blocking plate 50 is arranged within the mixing chamber 16 to oppose an aperture 19 of guide member 18 and secured at its inner periphery to the cylindrical portion 21 of flange member 25 by means of the tapered head pipe **21*a* between the air inlet valve units 35 and the aperture 19 of guide member 18 to block radiant heat of the combustion products applied thereto from the combustion chamber 11. In this embodiment, the heat-blocking plate 50 is formed to be larger in diameter than the aperture 19 of guide member 18. The amount of radiant heat applied from the combustion chamber 11 through the aperture 19 of guide member 18 becomes large at a central portion of the mixing chamber 16 opposed to the aperture 19 of guide member 18 and becomes small at a peripheral portion of the mixing chamber 16. For this reason, the outer diameter of heat-blocking plate 50 is determined to protect the air inlet valve units 35 on the inside common circular path from the radiant heat. Although in this embodiment, the tapered head pipe 21*a* has been screwed into the inner end of cylindrical portion 21, a cup-shaped distribution head may be coupled with the inner end of cylindrical portion 21 to protect the gas inlet valve unit 45** from the radiant heat of the combustion products.

For operation of the pulse combustion device, gaseous fuel is supplied into the mixing chamber 16 from the gas container 56 through the gas inlet valve unit 45, while the air is supplied into the mixing chamber 16 from the air flow passage 26 through the air inlet valve units 35. The gaseous fuel is mixed with the incoming air in the mixing chamber 16 and supplied into the combustion chamber 11 through the aperture 19. On start up, the mixture of gaseous fuel and air is ignited by energization of a spark plug (not shown). The pressure of the resulting rapid combustion of the mixture closes the air inlet valve units 35 and gas inlet valve unit 45 and forces the combustion products to exhaust from the tailpipe. When resonant combustion is initiated, oscillation takes place in the tailpipe, creating alternate positive and negative pressures in the tailpipe. During periods of negative pressure in the combustion chamber 11, the air inlet valve units 35 and gas inlet valve unit 45 are simultaneously opened to introduce fresh air and gaseous fuel into the combustion chamber 11 through the mixing chamber 16. The mixture of fresh gaseous fuel and air is reignited by a flame caused by the pulse combustion. During intermittent periods of positive pressure in the combustion chamber 11, the air inlet valve units 35 and gas inlet valve unit 45 are closed. The reignition of each fresh air-fuel mixture is continuously repeated at a frequency, for instance, about 100 cycles per second.

During the operation described above, the mixing chamber 16 is exposed to radiant heat of the combustion products applied from the combustion chamber 11 through the aperture 19. In this embodiment, however, the heat-blocking plate 50 blocks a large portion of the radiant heat to protect the air inlet valve units 35 from damage caused by the radiant heat directly applied thereto. This is useful to enhance the durability of the air inlet valve units 35.

Although the preferred embodiment of present invention has been shown and described, it should be understood that various modifications of the embodiment may be resorted to without departing from the scope of the invention as disclosed and claimed herein.

What is claimed is:

1. A pulse combustion device comprising a housing forming therein a combustion chamber, a cylindrical support member joined to said housing to form a mixing chamber in open communication with the combustion chamber, an annular perforated flange member coupled with an open end of said support member and having a cylindrical portion provided at its center to form a gas passage in communication with the mixing chamber, an air inlet valve assembly mounted within said flange member to allow inward flow of air passing therethrough into the mixing chamber and to block outward flow of the air from the mixing chamber, and a gas inlet valve assembly disposed within said cylindrical portion to allow inward flow of gaseous fuel passing therethrough into the mixing chamber and to block outward flow of the gaseous fuel from the mixing chamber, wherein an annular heat-blocking plate is arranged within the mixing chamber to oppose an aperture between the mixing chamber and the combustion chamber and mounted on the cylindrical portion of said flange member between said air inlet valve assembly and said aperture to block radiant heat of combustion products applied thereto from the combustion chamber through the aperture for protecting said air inlet valve assembly.

2. A pulse combustion device as claimed in claim 1, wherein said air inlet valve assembly includes an annular valve plate formed with a plurality of circumferentially equally spaced air ports and being secured to an annular end surfaces of said flange member and said cylindrical portion, and a plurality of circumferentially equally spaced air inlet valve units mounted on said valve plate on a common circular path concentric with the gas passage.

3. A pulse combustion device as claimed in claim 1, wherein said heat-blocking plate is larger in diameter than said aperture between the mixing chamber and the combustion chamber.

4. A pulse combustion device as claimed in claim 1, wherein said heat-blocking plate is secured in place by means of a head pipe screwed into an inner end of the cylindrical portion of said flange member.

5. A pulse combustion device as claimed in claim 1, wherein the cylindrical portion is integrally formed with said flange member.

* * * * *